US008314750B1

(12) United States Patent
Josypenko

(10) Patent No.: US 8,314,750 B1
(45) Date of Patent: Nov. 20, 2012

(54) SLOTTED BIFILAR OR QUADRIFILAR HELIX ANTENNA

(75) Inventor: Michael J. Josypenko, Norwich, CT (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 393 days.

(21) Appl. No.: 12/769,195

(22) Filed: Apr. 28, 2010

(51) Int. Cl.
*H01Q 1/36* (2006.01)
*H01Q 13/10* (2006.01)

(52) U.S. Cl. ..... 343/895; 343/767; 343/770

(58) Field of Classification Search ..... 343/745, 343/746, 767–771, 895
See application file for complete search history.

(56) References Cited

U.S. PATENT DOCUMENTS

| | | | | |
|---|---|---|---|---|
| 6,088,000 | A * | 7/2000 | Ho | 343/770 |
| 2008/0122733 | A1 * | 5/2008 | O'Neill et al. | 343/895 |
| 2008/0136723 | A1 * | 6/2008 | Tavassoli Hozouri | 343/767 |

* cited by examiner

*Primary Examiner* — Jacob Y Choi
*Assistant Examiner* — Scott Petersen
(74) *Attorney, Agent, or Firm* — James M. Kasischke; Jean-Paul A. Nasser; Michael P. Stanley

(57) ABSTRACT

A slotted bifilar or quadrifilar helix antenna has a plurality of helical antenna elements. The antenna elements have an outer planar surface. A slot element is secured to an interior of the outer planar surface. The slot element extends radially inwardly to a slot element edge. At least two radially opposite slot element edges define a tapered slot. At a shorted point on the antenna, at least one radially opposite pair of slot elements are electrically shorted together. A feed point is axially offset from the shorted point along the antenna axis.

12 Claims, 10 Drawing Sheets

SLOTTED BIFILAR OR QUADRIFILAR HELIX ANTENNA

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION

1. Field of the Invention

The present invention relates generally to helix antennas and, more particularly, to methods of feeding and matching bifilar and/or quadrifilar slotted helix antennas. In one possible embodiment, a pipe of cables passes through the slotted helix antenna.

2. Description of the Prior Art

A bifilar helix antenna comprises two antenna elements. A quadrifilar helix antenna effectively has two bifilar antennas spaced ninety degrees apart from each other about the antenna axis.

U.S. Pat. No. 4,349,824 to E. Harris, issued Sep. 14, 1982, discloses an around-a-mast quadrifilar microstrip antenna where a down link UHF antenna is designed which includes four equally spaced arms plated at an angle on a fiberglass cylinder. A coaxial connector is connected to each of the four arms with the metal plated inner surface as the common ground. This helix has an inner metal cylinder, which serves as the metal plated inner surface described above, inserted up its axis to allow cables and other functions to pass the antenna. This forces the normal on axis quadrature feed point to be spread out symmetrically to at least the diameter of the inner cylinder. The presence of the inner cylinder symmetrically placed within the antenna allows the feed end of each element to be referenced to the common cylinder, so that that the feed end of each element can be fed via the center conductor of a coaxial cable, whose outer conductor is connected to the inside of the common cylinder. The common cylinder can be referenced as a ground plane only if it is large enough, to the extent where coupling between an element and the cylinder dominates coupling between an element and its radially opposite corresponding bifilar element. The antenna is fed via four coaxial cables that feed in phase quadrature, all referenced to the common cylinder. Placement of an inner cylinder on the antenna axis reduces the bandwidth of the antenna. Bandwidth decreases with the diameter of the inner cylinder. Thus, the inner cylinder should be of minimum diameter.

Normally, a prior art helix antenna is wrapped about a cylinder axially centered on the antenna axis, for a certain number of turns or pitch angle.

In the feed region, the two elements of a bifilar antenna bend radially and taper in width towards the axis to two points, which become the feed point of the helix. The bent and tapered section of the element may be referred to as a feed arm. The two feed points are fed one hundred eighty degrees apart in phase. For the quadrifilar helix antenna, ninety degrees is added or subtracted to the feed phase of the second bifilar pair, depending upon which end of the helix the unidirectional pattern is to radiate from.

A typical impedance locus of a bifilar helix antenna when the total element length is ¼ wavelength and the diameter is 0.1 to 0.2 wavelengths starts as an open circuit impedance at zero frequency, and spirals quickly with frequency to and through a low resonance resistance of $R_0$. Typical values of $R_0$ are in the range of 5 to 10 ohms. Other impedance resonances are also possible, such as ½ wavelength shorted, and ¾ wavelength open. They are similar to the ¼ wavelength open impedance, except for the fact that they have higher $R_0$ values.

The bandwidth of the helix is reduced some by the indirect path of an antenna element from the feed point to the end thereof. This is largely due to the bend where the radial sections of the antenna elements begin. Maximum bandwidth occurs with a minimum path length (straight path) from the feed point to the element end, while maintaining the antenna radius/volume. Any extra path length adds inductance to the impedance of the element.

A shorted end fire slot antenna typically has an exponential taper of the antenna elements. Beyond the feed point, the antenna is open where most of the radiation occurs. Before the feed point, is a shorted inductive section. Since the shorted section is implemented on the antenna, a small radiation is associated with it. If the shorted section becomes narrow enough, it essentially becomes an inductance with no radiation loss and thus can be replaced by a simple inductance. Radiation from the shorted section will improve overall antenna impedance bandwidth.

Two possible geometries are utilized in the shorted section. In one geometry, a common elongated path realizes an inductance and an alternative geometry where the slot is simply continued and then shorted. The shorted section is an inductance that matches the antenna. The inductive short wraps the low frequency part of the resonance locus from near an open impedance to a short, introducing a loop, which can increase bandwidth over the bandwidth of the frequencies of the loop. At some point, part or all of the locus loop wraps about or is centered about a higher $R_0$ (which may preferably be 50 ohms), which is partially determined by the width and the taper of the slot. The locus is tighter and has more bandwidth for wider antennas because radiation also starts to occur along the width dimension perpendicular to the slot of the antenna.

An open end fire slot is combined with a flared bowtie antenna to make a hybrid antenna called the Slotline/Bowtie Hybrid Antenna. From the feed end of the slot, the antenna flares out in a bowtie shape in the cylindrical space square to the slot surface and parallel to the slot axis. The slot edge becomes two dimensional, thus increasing the possible bandwidth of the antenna. The antenna has large pattern and impedance bandwidth.

In certain prior art quadrifilar helix antennas, the four antenna elements taper radially (radial feed arm sections of elements) from a quadrature feed point and then bend over the end of a support tube to continue down the length of the tube as a helix. On certain of these antennas, the antenna elements are metal tubes. To allow cables to pass the antenna, a sheath of cables passes by most of the antenna by existing on the antenna axis, which is an rf=0 point. At the feed point, the sheath of cables bends around the feed point between two radial feed arms, and then continues along the antenna axis. Although the bend introduces an asymmetry in the geometry, it only has a small effect on antenna impedance and pattern symmetry.

The present invention provides an alternate method of feeding and matching a bifilar or quadrifilar helix antenna. In one embodiment of the invention, a pipe of cables passes the antenna.

SUMMARY OF THE INVENTION

It is a general purpose of the present invention to provide an improved bifilar or quadrifilar helix antenna.

One possible object of the present invention is to provide a slot which may be utilized to feed a bifilar or quadrifilar helix.

Another possible object of the present invention is to utilize a slot to increase the impedance bandwidth of a bifilar or quadrifilar helix.

Another possible object of the present invention is to utilize a slot for better impedance matching to a small bifilar or small quadrifilar helix when the end thereof is shorted.

Accordingly, the present invention provides a slotted helix antenna which may comprise elements such as, for example, a plurality of helical antenna elements. Each helical antenna element may comprise an outer planar surface which spirals around an antenna axis. A slot element is secured to a central interior portion of the outer planar surface. The slot element extends radially inwardly from the outer planar surface. Each slot element provides an interior slot element edge whereby two radially opposite interior slot element edges define at least one tapered slot therebetween.

A point may be provided at an end of the antenna where the plurality of slot elements are electrically shorted together. For instance opposing slot element edges are shorted together. A feed point is axially offset with respect the antenna axis from the shorted point.

The slot element edge may be described by the following equations:

$$R = K(e^{a\theta} - 1)$$

and $$K = \frac{R_{max}}{(e^{a\theta_{max}} - 1)}$$

where:

θ is the angular distance between the slot axis and a given point on the slot edge, where the center of the angle is at the shorted end of the helix. θ varies from zero at the shorted end to $\theta_{max}$ at the further most end point of the slot edge. R is the distance from the shorted point to a given point on the slot edge for a given value of θ. $R_{max}$ is the maximum distance from the shorted point to furthermost end point of the slot element;

$\theta_{max}$ is the angle where of $R_{max}$ occurs;

K is a constant determined by the conditions at Rmax and at the shorted end of the slot where θ and R are zero; and a is the constant of exponentiation that determines the rate of exponentiation of the slot element edge.

The slotted helix antenna may further comprise a coaxial cable having an outer conductor and center conductor at the feed point. The coaxial cable provides electrical connections with the slot element edges.

In one embodiment, the slotted helix antenna may further comprise a feed pipe which extends through the slot. At the shorted point, the slot elements are electrically shorted to the pipe. At the feed point, at least two coaxial cables provide electrical connections to opposite sides of the pipe and to at least two of the plurality of slot element edges. These at least two slot element edges must be a radial pair, i.e. two edges 180 degrees apart.

The present invention also provides a method for making a slotted helix antenna, which may comprise method steps such as, for example, providing a plurality of helical antenna elements wherein the helical antenna element comprise an outer planar surface which spirals around an antenna axis. The helical elements may further comprise a slot element secured to a central interior portion of the outer planar surface. The slot elements extend radially inwardly from the outer planar surface.

Other steps may comprise providing that the slot element extends along at least a portion of the length of the outer planar surface and that each slot element defines at least one slot element edge. Two radially opposite of slot element edges define one tapered slot therebetween.

Other steps may comprise providing a shorted point at which the plurality of slot elements are electrically shorted, e.g., a single pair of slot elements in the bifilar slot helix antenna are shorted together. Opposing pairs of slot elements in the quadrifilar slot helix antenna are shorted together.

Other steps may comprise providing a feed point axially offset from the shorted point with respect the antenna axis.

The method may comprise providing that at the feed point a coaxial cable makes a connection to one or two slot element edges.

The method may further comprise providing a feed pipe which extends through the slot. The method may further comprise providing that at the shorted point, the slot elements are electrically shorted to the pipe. The method must further comprise providing that at the feed point two coaxial cables are connected to the pipe and to two of the radially opposite of slot element edges.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION OF THE INVENTION

Figure 1A:
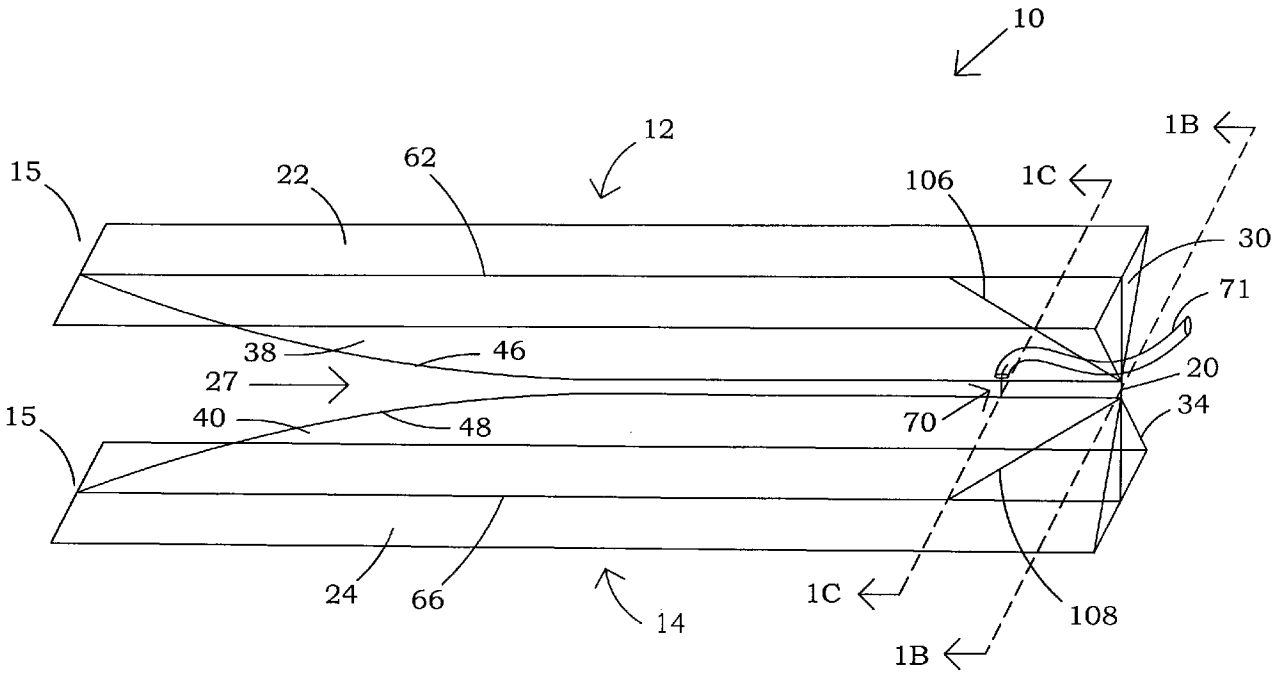
FIG. 1A is a side perspective view of a bifilar slotted helix antenna in accord with one possible embodiment of the present invention with the helix antenna elements shown having the outer planar surfaces flat rather than rounded for easier viewing and where the helix shape is untwisted to have a pitch angle of 90 degrees.
Figure 4:
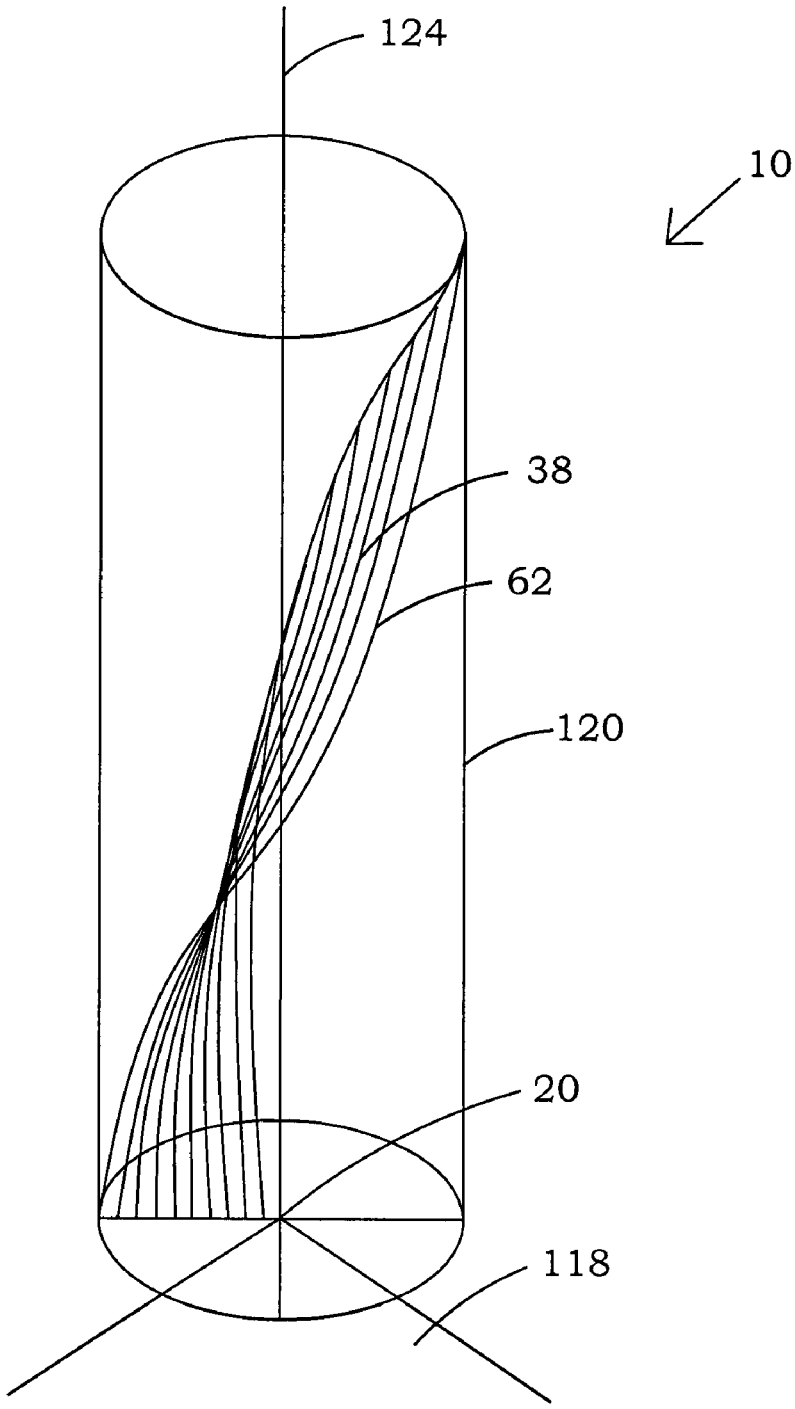
FIG. 4 is a contour line view of a slot element of one helix slotted antenna element, with contour lines added to illustrate the contour of the slot element, which are drawn along the length of the helix antenna in accord with one possible embodiment of the present invention.
Figure 5:
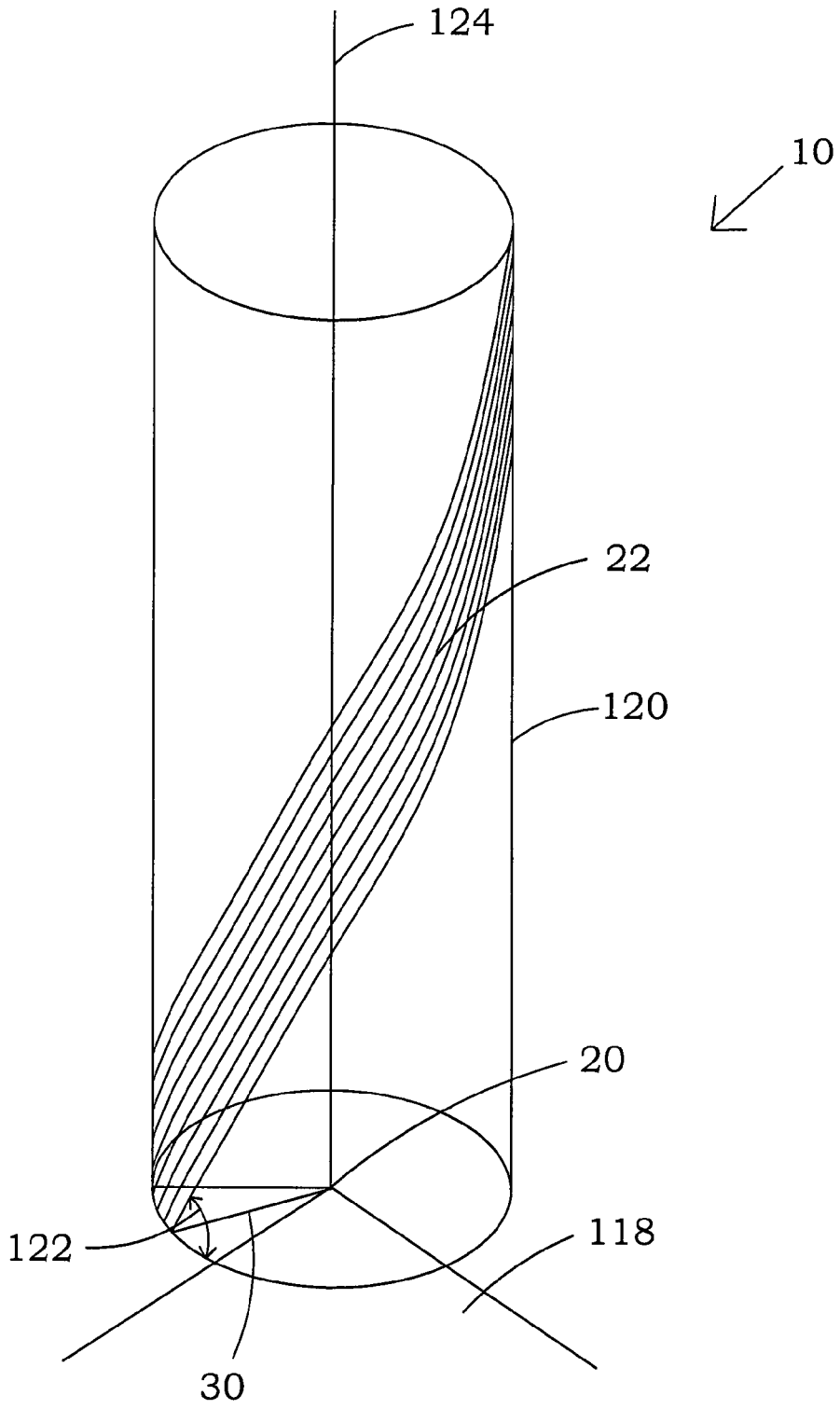
FIG. 5 is a contour line view of the outer planar surface of one slotted helix antenna element, with contour lines added to illustrate the contour of the slot element, which are drawn along the length of the slotted helix antenna in accord with one possible embodiment of the present invention.
Figure 6:
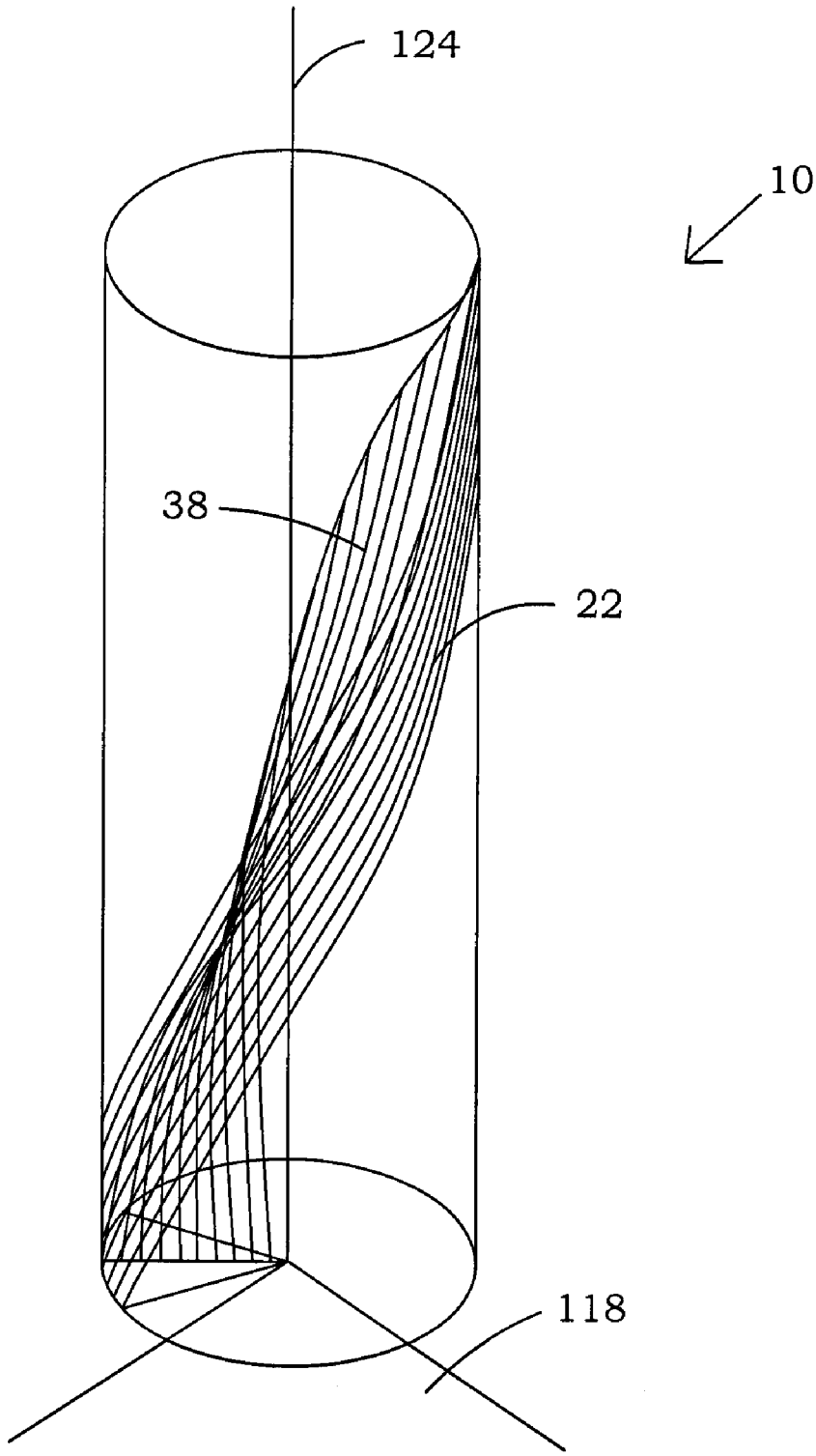
FIG. 6 is a contour view of a helix antenna element combining the slot element of FIG. 4 with the outer planar surface of FIG. 5 and which is illustrated with contour lines added to show the contours thereof in accord with one possible embodiment of the present invention.

Referring now to the drawings and, more particularly, to FIG. 1A, there is shown a bifilar slotted helix antenna, which is one possible embodiment of slotted helix antenna 10 of the present invention. FIG. 1A shows a side perspective view of a bifilar slotted helix antenna with helical antenna elements 12 and 14 untwisted to a helix pitch angle of 90 degrees. The helix pitch angle of helical antenna elements will normally be lower than 90 degrees as shown in FIG. 4, FIG. 5, and FIG. 6.

The outer planar surfaces 22 and 24 of the helix elements of the antenna are shown with a flat outer planar surface as opposed to rounded for easier viewing.

Figure 1C:
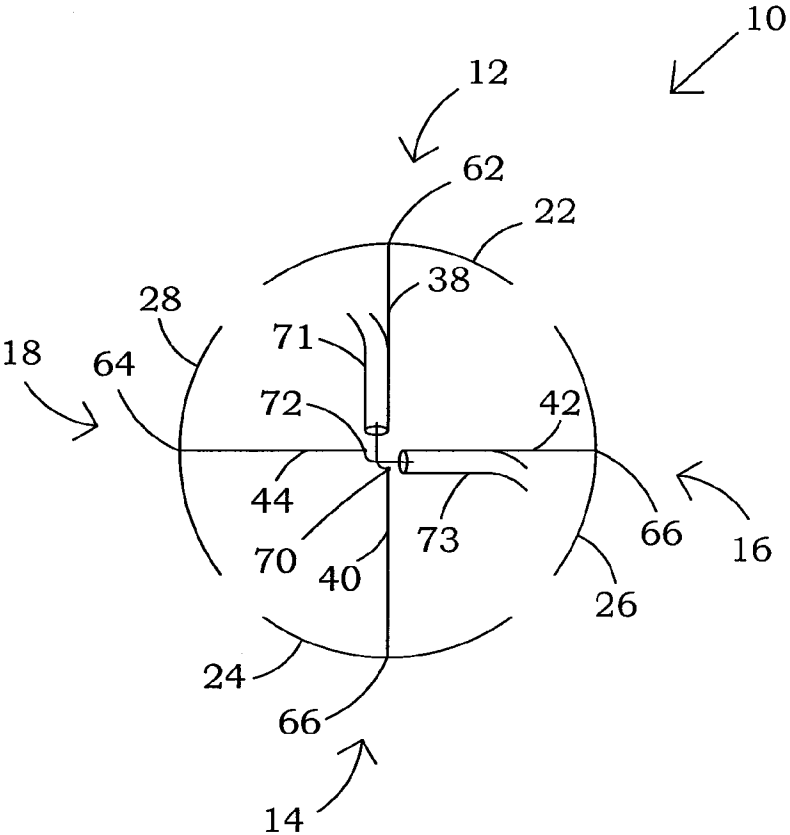
FIG. 1C is a cross-sectional view at lines 10-10 of FIG. 1A of the feed region of the slotted helix antenna, also having added antenna elements to provide a quadrifilar slotted helix antenna and with the outer planar surfaces being rounded instead of flat as shown in FIG. 1A in accord with one possible embodiment of the present invention.
Figure 1B:
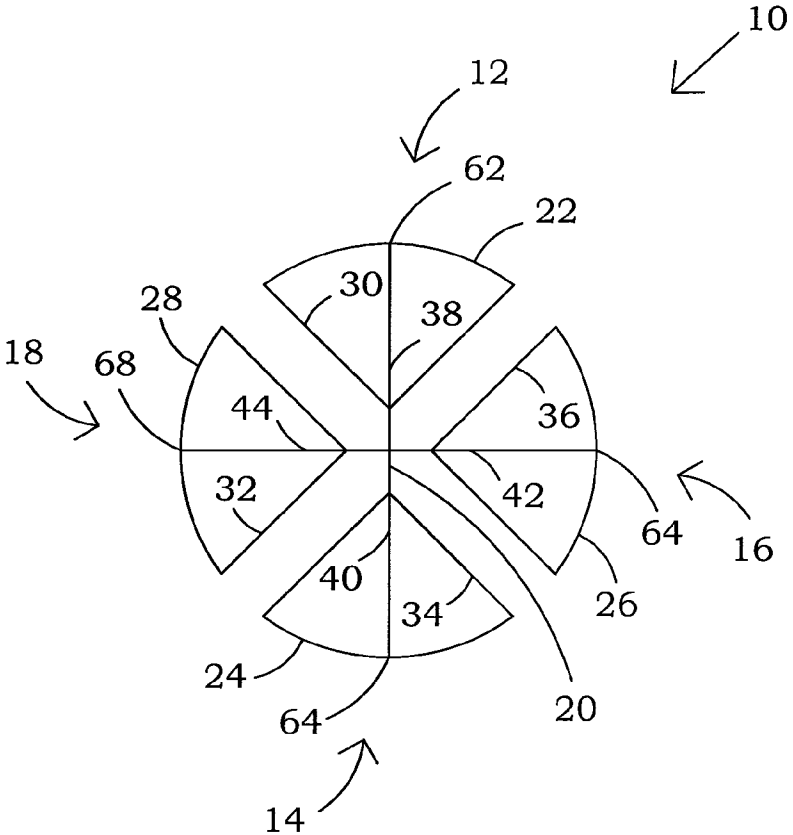
FIG. 1B is an end perspective view at lines 1B-1B of FIG. 1A where the shorted end is located and with added antenna elements to provide a quadrifilar slotted helix antenna and with the outer planar surfaces being rounded instead of flat as shown in FIG. 1A in accord with one possible embodiment of the present invention.

FIG. 1B shows the end view for the antenna for the quadrifilar case, where a short 20 of antenna elements 12 and 14, and 16 and 18 is located. FIG. 1B shows outer planar surfaces 22, 24, 26 and 28 being rounded so that the outer planar surfaces are at a constant radius from the axis of the antenna, which goes though the center of the slotted helix antenna 10. FIG. 1C shows the cross sectional view of the feed region for the quadrifilar case. For the quadrifilar version of the antenna, two bifilars would be interleaved about the antenna axis as has been done for a standard prior art quadrifilar helix antenna discussed hereinbefore.

While four antenna elements 12, 14, 16, and 18 are shown for the quadrifilar case in FIGS. 1B and 1C, when discussing the bifilar case it will be understood that two radially opposite elements comprise a bifilar helix, e.g., antenna elements 12 and 14. Two pairs of bifilar antenna elements ninety degrees apart from each other along the antenna axis constitute a quadrifilar helix, e.g., antenna elements 12 and 14 are ninety degrees apart from antenna elements 16 and 18. Normally antenna elements 12, 14, 16, and 18 have rounded outer planar surfaces 22, 24, 26, and 28, respectively, that wind around the cylinder of the antenna but are shown flat for easier viewing and are shown unwound in FIG. 1A and FIG. 2A.

Outer planar surfaces 22, 24, 26 and 28 are the portions of the antenna elements 12, 14, 16, and 18 which lay along the length and planar surface of slotted helix antenna 10.

Interior radial sections 30, 34, 36, and 32 are radial sections of antenna elements 12, 14, 16, and 20 that bend and taper towards short 20 of the helix. In prior art helix antennas, what is the shorted end of the antenna would have been the feed point of the antenna. Interior radial sections 30, 34, 36, and 32 are tapered to the width of the outer planar surfaces 22, 24, 26 and 28 respectively, as opposed to being simple wires, to reduce excessive inductance and to reduce the distance from the feed point to the end of the antenna, which also reduces excessive inductance. Excessive inductance reduces impedance bandwidth.

With the introduction of slot 27 and its associated slotted elements 38 and 40 in the slotted helix antenna 10 of the present invention, the width of the slot elements, such as slot elements 38 and 40, and the new direct and thus reduced radiation path length from the feed point 70 to the open end of the antenna 15, reduces excessive inductance. Since radial interior sections 30, 34, 36, and 32 no longer have significant radiation due to not being part of the main radiation path and due to the presence of the slot elements, their inductance reducing features are no longer important. Also since the slot elements also provide a shorting path across the end of the antenna, in one possible embodiment, radial interior sections 30, 34, 36 and 32 may simply be replaced by the ends of slot elements 38, 40, 42 and 44.

In FIG. 1A, bifilar helix slot elements 38 and 40 define slot 27. For the quadrifilar helix case there are effectively two slots which are fed and arranged 90 degrees apart about the antenna axis.

Figure 1D:
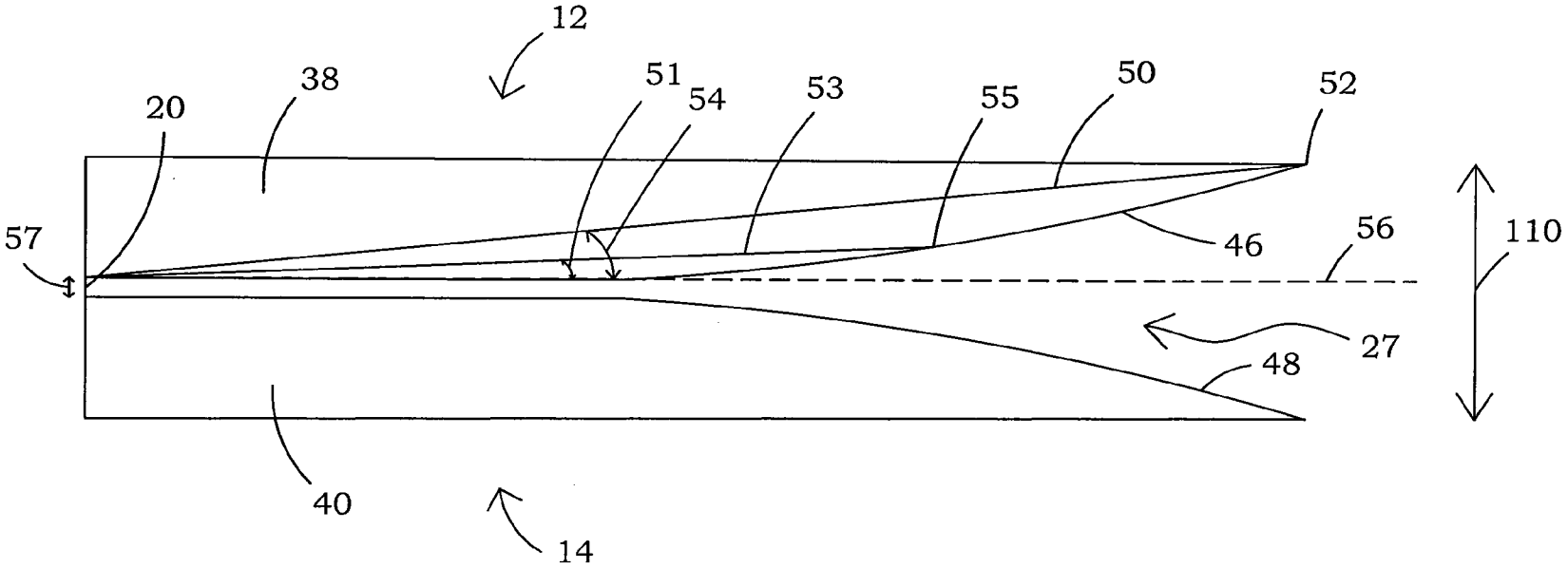
FIG. 1D is a side elevational view of a bifilar slotted helix antenna; untwisted which shows features used to define a slot taper for a slotted helix antenna in accord with one possible embodiment of the present invention.

Edges 46 and 48 define slot 27. FIG. 1D shows various features and parameters associated with equations that describe slot 27. The taper of edges 46 and 48 is exponential. The equations below are in polar form in that the distance to a point on the slot 27 from its shorted end 20 is determined by the angle relative to the axis of the slot. To more conveniently measure angle 54, which is $\theta_{max}$ as discussed below, or any angle $\theta$, as indicated at 51, pseudo axis line 56 is drawn parallel to the axis of the antenna but is offset by W/2 where W is the width 57 at short 20 of slot 27.

$$R = K(e^{a\theta} - 1)$$

$$K = \frac{R_{max}}{(e^{a\theta_{max}} - 1)},$$

where $\theta$ is the angular distance between the pseudo slot axis 56 and a given point on the slot edge, where the center of the angle is at the shorted end of the helix on the pseudo axis. $\theta$ varies from zero at the shorted end to $\theta_{max}$ at the further most end point of the slot edge. R is the distance from the shorted point to a given point on the slot edge for a given value of $\theta$. $R_{max}$ 50 is the maximum distance from shorted end 20 to end point 52 at the end of slot 27, where end point 52 is the furthest most point on slot element 38 from shorted end 20. Other examples of any distance R may be provided as indicated by line 53 which terminates along edge 46 at point 55.

$\theta_{max}$ is angle 54 where $R_{max}$ 50 occurs with respect to axis 56 of slot 27.

K is a constant determined by the conditions at Rmax and at the shorted end of the slot where θ and R are zero.

a is the constant of exponentiation that determines the rate of exponentiation of slot 27 and determines what part of the exponential curve is used to define the slot shape. At one extreme, the curve is linear. Close to the other extreme, the curve is highly curved near the end of slot 27, being almost square in shape.

W is the separation 57 between the two antenna elements 12 and 14 of slot 27 at the shorted end 20.

Referring to FIG. 1A, FIG. 1B, FIG. 1C and FIG. 3, seams or connections lines 62, 66, 64, and 68 are the seams or connection lines at the centers of antenna elements 12, 14, 16, and 18, by which the radially outermost edge of slot elements 38, 40, 42, and 44 must be connected by solder or other means to the center of outer planar surfaces 22, 24, 26 and 28 of the quadrifilar (or 22, 24 for bifilar) slotted helix antenna 10.

Referring to FIG. 1A feed point 70 is the feed point of a bifilar version of slotted helix antenna 10 utilizing coaxial cable 71. In this example, the sheath or outer conductor of coaxial cable 71 is soldered to edge 46 and the path along 38 between feed point 70 and the end of the helix near 20 and the center conductor is connected to edge 48. For the quadrifilar case, each bifilar antenna has a feed point as perhaps best shown in FIG. 10 or FIG. 3 with the two resulting feed points 70 and 72 being fed with signals having a ninety degree phase difference and utilizing coaxial cables 71 and 73. As discussed hereinbefore, the outer conductor of the coaxial cable is connected to the edge of a slot element and the center conductor is connected to the edge of the corresponding opposite slot element at the feed point.

Figure 2A:
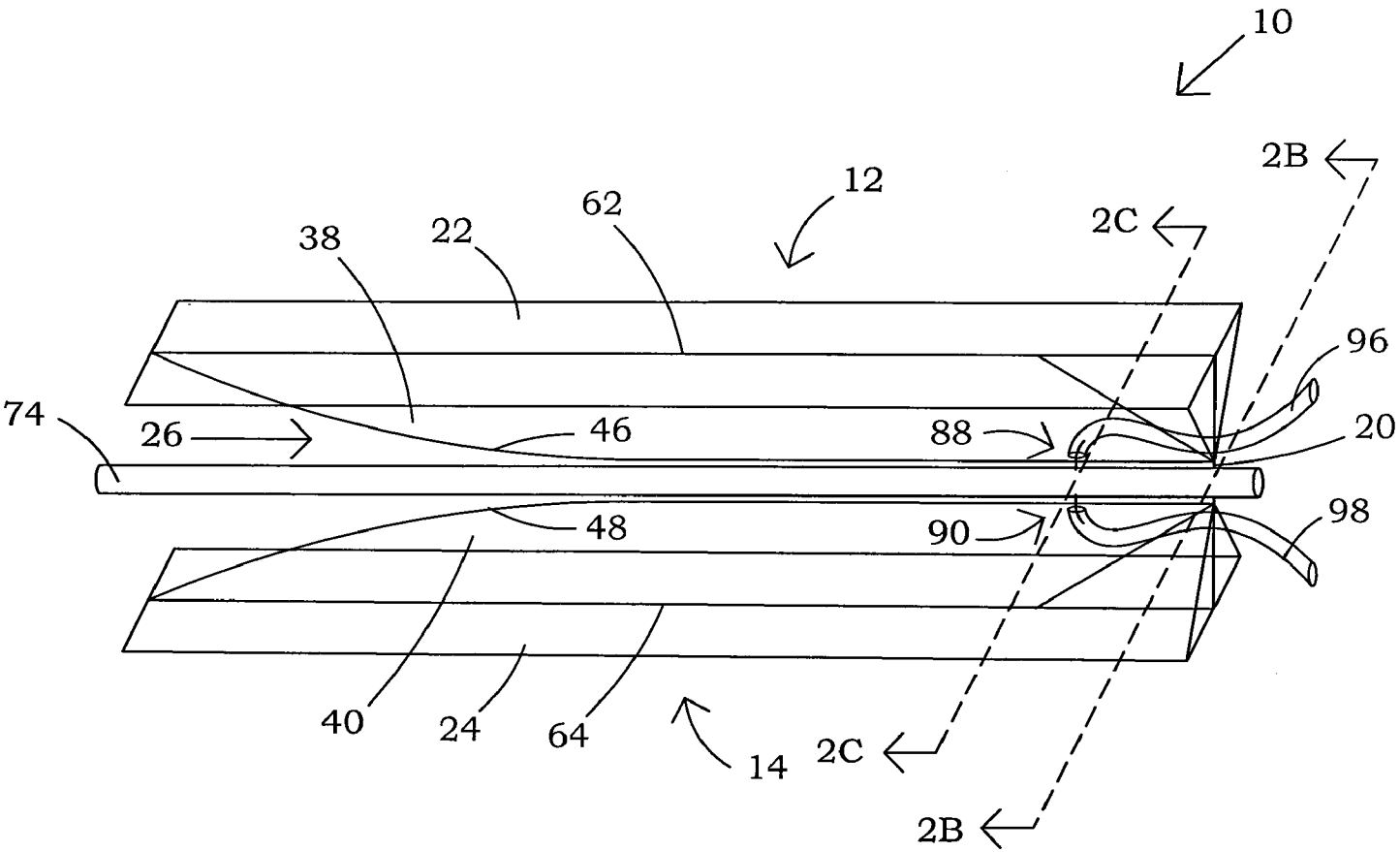
FIG. 2A is a side perspective view of a bifilar slotted helix antenna with the helix antenna elements shown with the outer planar surfaces being flat rather than rounded for easier viewing and where the helix shape is untwisted to have a pitch angle of 90 degrees and showing a pipe down the center of the antenna axis.
Figure 7:
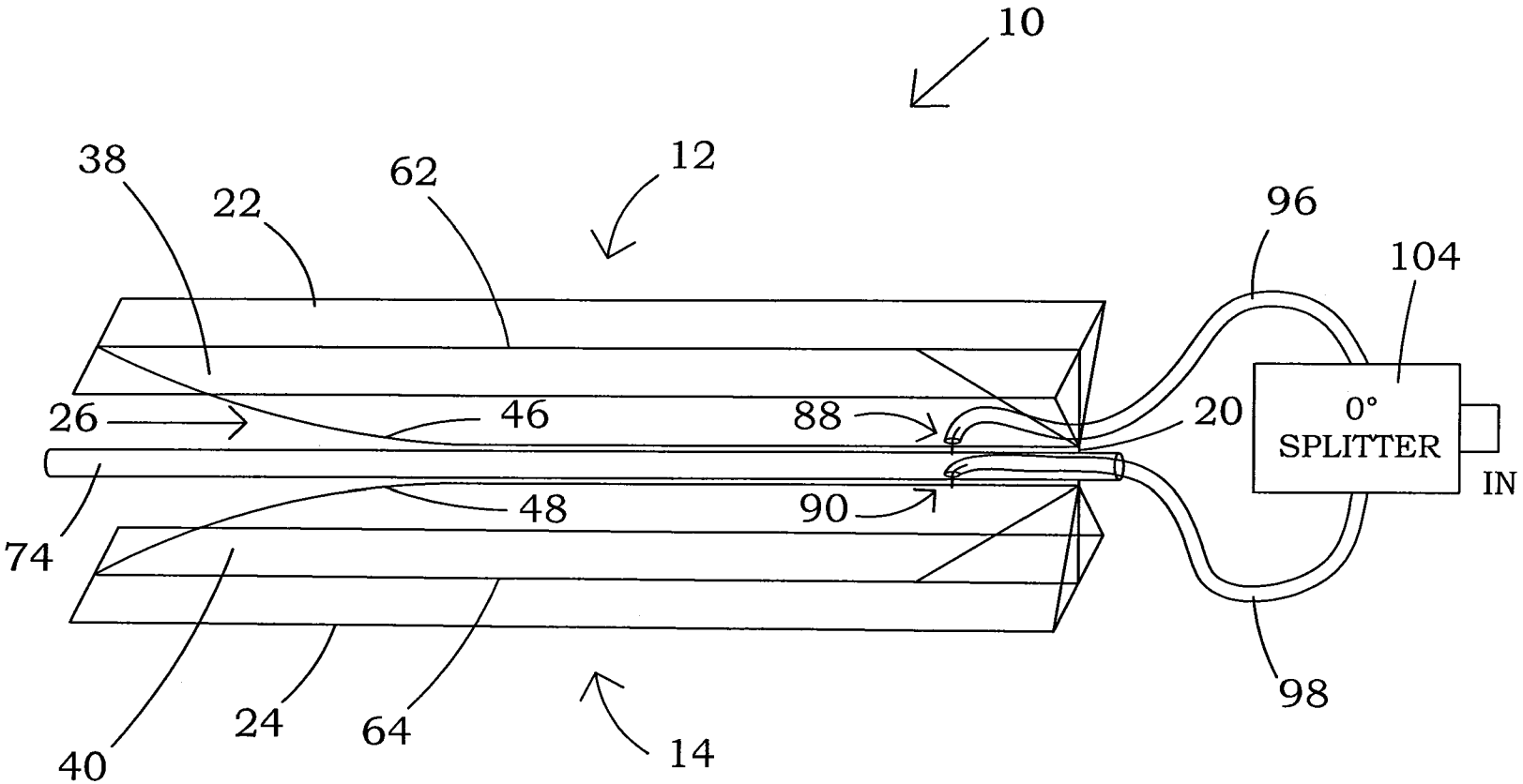
FIG. 7 is a side perspective view of a bifilar helix antenna with the helix elements shown flat rather than round for easier viewing in accord with the present invention which is untwisted at a pitch angle of 90 degrees, with a pipe down the center of the antenna axis and wherein the antenna is fed with a 0 degree power splitter.

Referring to FIG. 2A and FIG. 7, when pipe 74 is used on the antenna axis, two coaxial cables instead of one are shown to feed the bifilar slotted helix antenna. For the case of a pipe up the antenna axis, two coaxial cables may be utilized, such as coaxial cables 96 and 98, because it would be difficult to spread the feed point of a single coaxial cable around a finite circumference of a pipe to feed both edges of the slot. If only one coaxial cable is used, then the center conductor must be spread around the pipe for a finite length, which adds inductance to the antenna impedance and also can unbalance the feed point.

Pipe 74 is a conductive pipe that may be utilized to carry wires (inside the pipe) past the short 20 and the feed points in accord with one possible embodiment of the present invention.

Two feed points 88 and 90 on opposite sides of pipe 74 are utilized in the type of feed shown in FIG. 2A. The feed points being fed 180 degrees apart utilizing two coaxial cables 96 and 98 by feed signals that are 180 degrees out of phase, e.g. by utilizing a 180 degree splitter (not shown). However, in the type of feed shown in FIG. 7, again two feed points 88 and 90 on are utilized on opposite sides of pipe 74, but a zero degree splitter 104 is utilized. The reasons for this, and the types of feeds and various permutations thereof are discussed hereinafter.

Figure 2C:
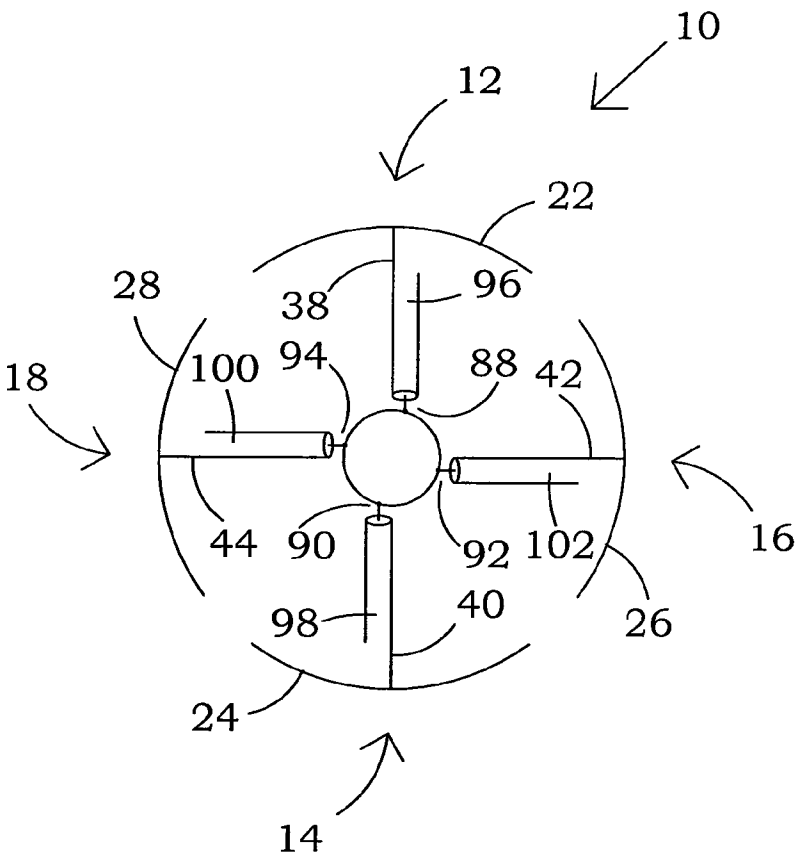
FIG. 2C is a cross-sectional view at lines 2C-2C of FIG. 2A of the feed region of a slotted helix antenna also having added antenna elements to provide a quadrifilar slotted helix antenna and with the outer planar surfaces being rounded in accord with one possible embodiment of the present invention.
Figure 2B:
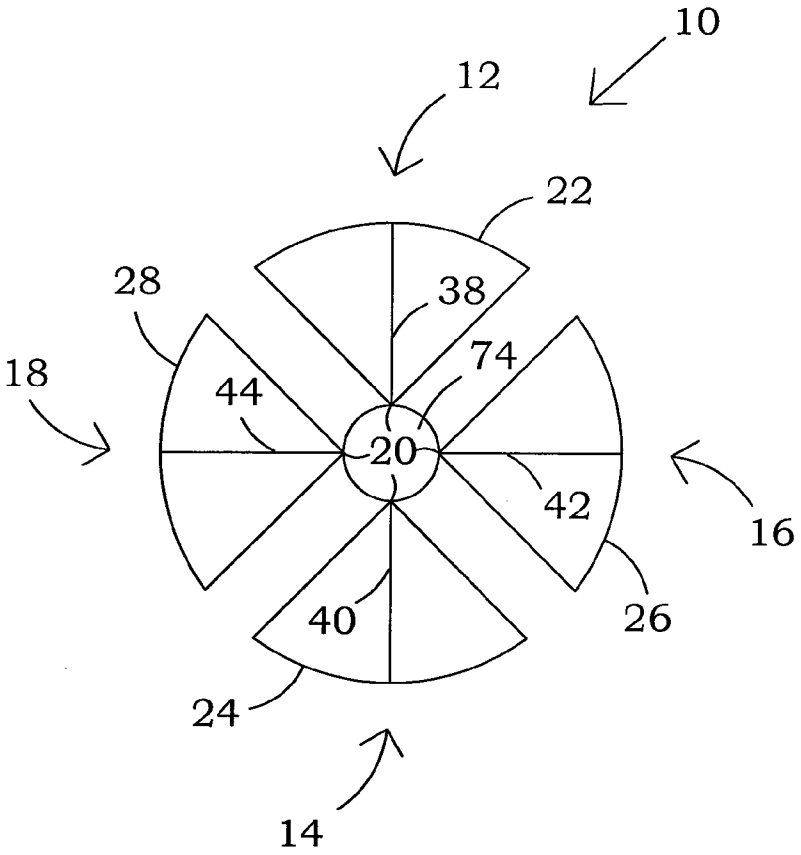
FIG. 2B is an end perspective view at lines 2B-2B of FIG. 2A where the short end is located with FIG. 2B also having added antenna elements to provide a quadrifilar slotted helix antenna and with the outer planar surfaces being rounded instead of flat as shown in FIG. 2B in accord with one possible embodiment of the present invention.

For the quadrifilar case where pipe 74 is used, as shown in FIG. 2B, slot elements 38, 40, 42, and 44 are shorted to pipe 74 as indicated at shorts 20.

At the feed position for the quadrifilar helix antenna case as indicated at FIG. 2C, four feed points 88, 90, 92, and 94 are fed with four coaxial cables 96, 98, 102, and 100. The feed points are fed with the traditional quadrature feed phase of a quadrifilar helix whereby in a circle around the four resultant feed points the adjacent feed points are physically separated by 90 degrees. Each corresponding feed signal advances or recedes 90 degrees in phase.

As shown in FIG. 2A, feed coaxial cables, such as feed coaxial cables 96 and 98, are introduced at short 20 and then snake along slot elements 38 and 40, with the outside of the outer conductor electrically connected to the element surface, and are then connected to the respective edge of the slot elements, edges 46 and 48. In this example each respective center conductor of the coaxial cables connects to the pipe and each inside of the outer conductor connects to one of the edges. In this manner, the antenna is being used as an infinite balun to allow introduction of a feed cable on the antenna.

Note that the introduction of the pipe provides for at least three ways to feed an antenna element. (1) A coaxial cable is introduced at short 20 and snakes its way to the feed point along the slot element as already discussed. (2) A coaxial cable is introduced at short 20 and snakes its way to the feed point along the outside of the pipe. At the feed point, the inside of the outer conductor connects to the pipe and the center conductor feeds the slot element. (3) A coaxial cable is introduced at the short and snakes its way to the feed point along the inside of the pipe. At the feed point, the cable protrudes through the pipe and the inside of the outer conductor connects to the pipe while the center conductor feeds the slot element. Permutations of the above three ways to feed the slot elements are possible, one example of which is shown in FIG. 7 where ways (1) and (3) are combined.

With the introduction of two feed coaxial cables per bifilar helix for the pipe case, as opposed to one feed coaxial cable without the pipe, now the two cables are suitably fed with a 3 db power splitter. If both antenna elements of a bifilar pair are fed the same way (using only 1 of the 3 possible ways discussed above), a 180 degree splitter is used. If one element is fed with the center conductor of a cable and the other element is fed with the outer conductor of a cable (using some cases of 2 of the 3 possible ways discussed above), a zero degree splitter is used.

FIG. 7 shows such an example with zero degree splitter 104. Feed point 88 is fed via a cable running along one of the slot element surfaces. Feed point 90 is fed with a cable that runs up the inside of pipe 74 and then protrudes from pipe 74 at feed point 90. This type of feed may be undesirable for some applications, since now the antenna is somewhat asymmetrical, due to slight differences in element geometry—one has a cable running along part of its length, the other does not. Note that the case of using a 180 degree power splitter changes the system Zo from 50 to 100 ohms.

Note that feed methods with the cable snaking along the pipe is allowed because the cables are introduced at an rf=0 point (the short) on the antenna. If the antenna is open, an element can only be fed from a cable on the pipe, then in this case, the symmetrically centered pipe places the pipe itself at an rf=0 point.

Referring to FIG. 1A, the edges may be as indicated at 106 and 108 for the case where the slot length is largely reduced in case the slot length produces pattern problems. Pattern problems probably can occur when the length of the antenna is larger than ¾ wavelength.

In prior art helix antennas, feed points were at the short of the helix antenna of the present invention. With the introduction of the slot, since helix elements and slot elements are connected, the original radial feed section of the helix, 30, 32, 34, and 36 can be eliminated.

Distance 110 in FIG. 1D is the maximum width of the slot 27, which also becomes the diameter of slotted helix antenna 10. In the antennas tested, the width is 0.1 wavelength at 1 GHz.

Figure 3:
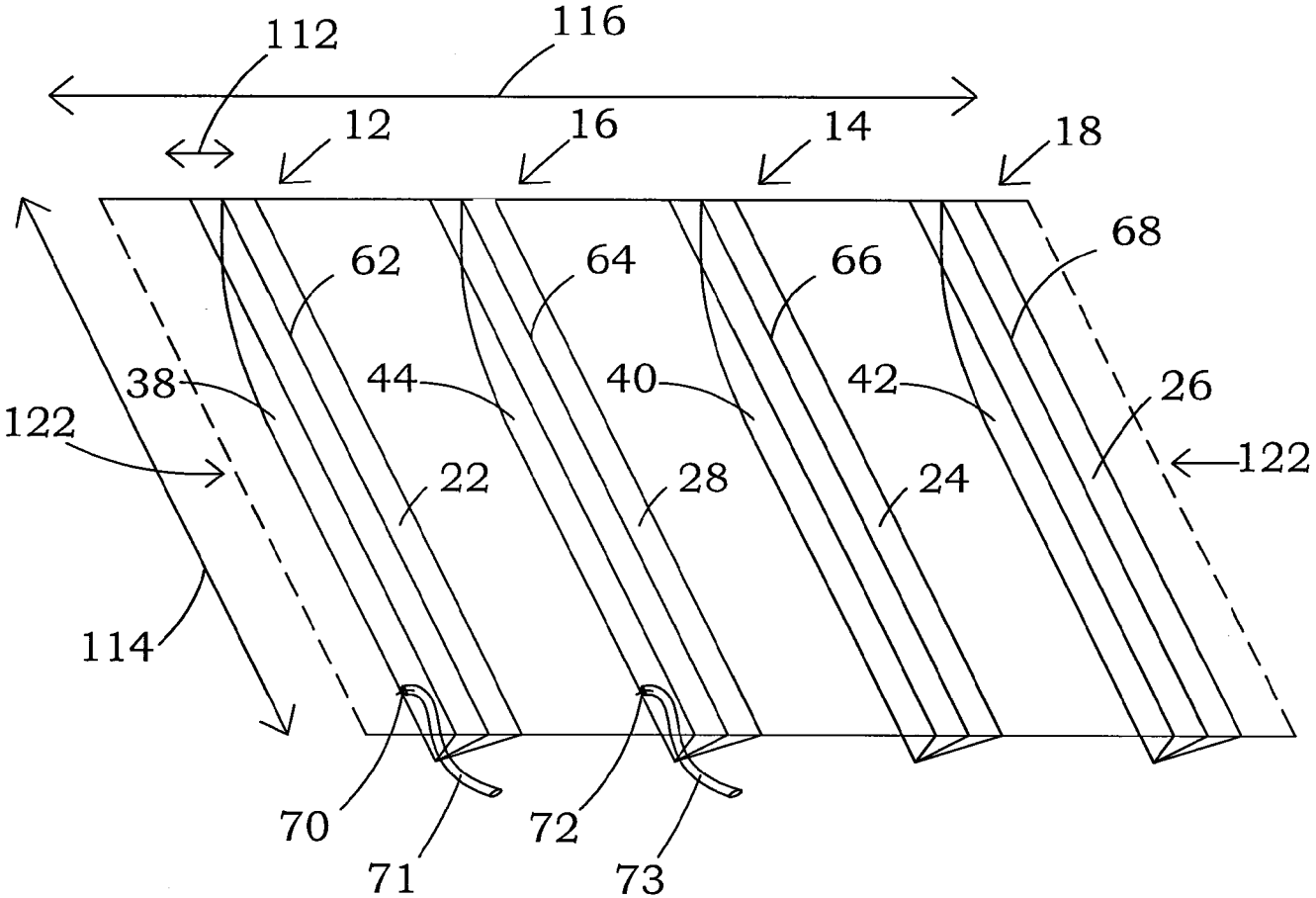
FIG. 3 is a perspective view of a quadrifilar slotted helix antenna unwrapped along a line parallel and midway between two adjacent helix antenna elements in accord with one embodiment of the present invention.

Referring to FIG. 3, distance 112 is the width of the helix elements. In one example, distance 112 is one inch, which is somewhat less than 0.1 wavelength at 1 GHz. Distance 114 is the length of the slot and helix elements. Lengths tested were 0.25, 0.5, and 0.75 wavelengths at 1 GHz. Distance 116 is the circumference of slotted helix antenna 10. Line 122 is a line parallel and midway between helix elements, where the metal or metal plated sheet where the antenna elements are mounted on is cut and unwrapped from the antenna cylinder to a plane to more easily view slotted helix antenna 10.

The pitch angle of the antenna is the angle with the horizon when the antenna axis is mounted vertical. For ease of construction and viewing, the antenna elements are vertical, and thus the pitch angle is 90 degrees. For most cases, this angle will be less, and the element will be twisted about the antenna axis, which is much harder to construct. Lower pitch angles will also increase impedance bandwidth.

Referring to FIG. 4, 118 is the horizon plane, above which slotted helix antenna 10 is normally mounted. Horizon plane 118 might be further divided to the front of the plane and the back of the plane. Cylinder 120 or other shape is the structure on which slotted helix antenna 10 is mounted, which determines the antenna shape. Line 124 is the antenna axis. FIG. 4 utilizes contour lines to show the shape of a slot element, which in this example is slot element 38. Seam or connection line 62 connects to the outer planar surface (not shown in FIG. 4 but is shown in FIG. 5 and FIG. 6). The slot, the helix, and the shorted end regions with the radial shorted sections may be mounted to sheet material. In the previously built antennas, the slot and helix were 4 mil copper tape mounted to 5 mil mylar sheet.

FIG. 5 shows outer planar surface 22 of slotted helix antenna 10 in contour lines. The antenna is mounted with respect to ground plane 118. Angle 122 is the helical pitch angle, which in this example is less than 90 degrees.

FIG. 6 shows the combination of FIG. 4 and FIG. 5 to illustrate the combination in contour lines of outer planar surface 22 and slot element 38.

For the ¼ wavelength long open antennas, impedance reactance to impedance resistance curves (reactance normalized to resistance) at the first ¼ wavelength resonance showed the antenna with the slot removed (a prior art helix antenna) has a normalized reactance changing quicker with frequency than some of the slotted helix antenna 10 versions (ignoring the small difference in frequency location of the resonances). The VSWR=3:1 bandwidth of the normal helix is 4.8%; the bandwidth of a slotted helix antenna with a taper where a=−0.3 is 6.3%. Thus the addition of the slot does improve the bandwidth as compared to a prior art helix antenna.

Some slot tapers do not improve bandwidth. Other factors, such as excessive capacitance along the slot for cases where the taper is almost square in shape, may decrease bandwidth.

The prior art helix antenna has a lower resonant frequency than the slotted helix antennas. This shows that the slots do reduce the path length from the feed to the end of the antenna.

Similar observations can be made for the ¾ wavelength antennas. The resonant frequency of the prior art helix antenna is lower than the slotted helix antennas at ¼ and ¾ wavelength resonances. At the ¼ wavelength resonance, the slope of the normalized reactance is appreciably larger for the prior art helix antenna. At ¾ wavelength resonance, there is little difference.

For the case of the antenna length from the feed point to its open end being ¼ wavelength at 1 GHz and the taper is with a=0.3, in tests it was found that the locus rotates counterclockwise towards the upper left quadrant of the Smith Chart and then towards a short, as the amount of shunting increases from almost none to almost total shunting, where the impedance is essentially a short. Increasing the shunting is accomplished by moving the short closer to the feed point. Along the way, an intermediate value of inductance allows the area of the impedance below the low resistance resonance to wrap nicely about 50 ohms.

Various alternatives are available. For example, extreme alternatives of the antenna can be made by removing parts of the antenna and/or simplifying the geometry. In one alternative, the radius of the antenna becomes small enough so the presence of the slot is not required to reduce the excessive path length of the elements due to radius, since the separation of the feed point is small. More generally, this alternative may occur when all of the slot except for two radial lengths at the feed point is simply removed and the bandwidth loss due to increased resultant element path length can be tolerated.

Like a prior art quadrifilar helix, the radial feed lengths could be flared normal to the axis, as the radial sections 22, 24, 26, and 28 are in the original antenna, to at least reduce excessive bandwidth robbing inductance on the radial feed lengths. In the extreme case where the radial feed lengths are short, inductance is small and the flares can be removed.

In one example, edges of the slot elements such as edges 46 and 48 may be substantially or entirely removed so that only short stubs remain to provide a path for the radial feed lengths to the helix elements. The outer conductor of the feed cable is one of the paths to one of the antenna elements. Since the slot element part of the helix element would be gone, the feed cable would now snake along the circumferential part of the helix element 22 down the flared section 30 at the antenna end, and to the short 20. Another dummy piece of cable can lead to the other antenna element feed point.

Another alternative conversely removes the helix elements and leaves the slot.

Yet another variation fills the rounded T shape (cross sectional view) of an antenna element to have a triangular shape, so there is no longer any distinction between the slot element and outer planar surface of a helical antenna element. Filling the area between the slot element and outer planar surface increases the shunt capacitance across a bifilar pair, lowering the impedance of the antenna. The capacitance may become excessive, to the point of lowering bandwidth, thus only a partial filling of the area may be desirable.

In general, it can be said for a given antenna structure composed of two spaced apart parallel element surfaces parallel to the axis through its feed points, maximum bandwidth is obtained when all paths are established from a given feed point to all of the edges of its fed element, and the lengths of the paths are minimized. The paths flaring from a feed point to the element edges establishes another new surface, which to a large extent shadows the original element surfaces and volume between the original surface and new surface, and thus the volume and any parts of the elements inside the volume can be eliminated. It may be concluded that the slot fed helix is only a partial solution to reducing path length from the feed point to the element edges, since it reduces path length only along the length dimension of the original helix element. The triangular shape antenna elements provide a total solution, since this shape also reduces the path length to the width of the outer planar surfaces.

Variations of the shunt inductance section between the feed point and the short will change the shunt inductance used to match the shorted case of the antenna. Increasing the distance between the feed point and short or decreasing the width of the section will increase the inductance. The extreme case is when the section is simply a narrow inductive wire. Decreasing the width would reduce any small radiation from the section. This may be required if the radiation is found to be undesirable.

Another variation connects the edge of the slot to the edge of a helix element, not to its center.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A slotted helix antenna, comprising:

a plurality of helical antenna elements, each helical antenna element comprising an outer planar surface which spirals around an antenna axis and a slot element secured to a central interior portion of said outer planar surface, said slot element extends radially inwardly from said outer planar surface, each slot element comprises a slot element edge, whereby at least two radially opposite slot element edges define at least one tapered slot therebetween;

a shorted point at which at least one radially opposite pair of said plurality of slot elements are electrically shorted; and a feed point axially offset from said shorted point with respect to said antenna axis.

2. The slotted helix antenna of claim 1, wherein said slot element edge is described by the following equations:

$$R = K(e^{a\theta} - 1) \text{ and } K = \frac{R_{max}}{(e^{a\theta_{max}} - 1)};$$

wherein θ is an angle that represents an angular distance between a slot axis and a given point on the slot element edge, where the center of the angle is at the shorted point of the plurality of helical antenna elements, and θ varies from zero at the shorted point to $\theta_{max}$ at a further most end point of the slot element edge;

wherein R is a distance from the shorted point to a given point on the slot element edge for a given value of θ;

wherein $R_{max}$ is a maximum distance from said shorted point to a furthermost end point of said slot element;

wherein $\theta_{max}$ is an angle where $R_{max}$ occurs;

wherein K is a constant determined by the conditions at $R_{max}$ and at the shorted end of the tapered slot where θ and R are zero; and wherein a is a constant of exponentiation that determines the rate of exponentiation of said slot element edge.

3. The slotted helix antenna of claim 1, further comprising a coaxial cable at said feed point electrically connected to a first of said plurality of slot element edges and to a radially opposite second of said plurality of slot element edges.

4. The slotted helix antenna of claim 1, further comprising a feed pipe which extends through an axis of said tapered slot.

5. The slotted helix antenna of claim 4, further comprising said slot elements being electrically shorted to said pipe at said shorted point.

6. The slotted helix antenna of claim 4, further comprising at least two coaxial cables being connected to said pipe and to at least two radially opposite slot element edges at said feed point.

7. A method for making a slotted helix antenna, comprising the steps of:

providing a plurality of helical antenna elements with an outer planar surface that spirals around an antenna axis;

securing a slot element to a central interior portion of said outer planar surface;

providing that said slot element extends radially inwardly from said outer planar surface;

providing that each slot element has at least one slot element edge, whereby at least two radially opposite slot element edges define at least one tapered slot therebetween;

providing a shorted point at which at least one radially opposite pair of said plurality of slot elements are electrically shorted; and providing a feed point axially offset from said shorted point with respect to said antenna axis.

8. The method of claim 7, further comprising the step of:

providing that said at least one slot element edge is described by the following equations:

$$R = K(e^{a\theta} - 1) \text{ and } K = \frac{R_{max}}{(e^{a\theta_{max}} - 1)};$$

wherein θ is an angle that represents an angular distance between a slot axis and a given point on the slot element edge, where the center of the angle is at the shorted point of the plurality of helical antenna elements, and θ varies from zero at the shorted point to $\theta_{max}$ at a further most end point of the slot element edge;

wherein R is a distance from the shorted point to a given point on the slot element edge for a given value of θ;

wherein $R_{max}$ is a maximum distance from said shorted point to a furthermost end point of said slot element;

wherein $\theta_{max}$ is an angle where $R_{max}$ occurs;

wherein K is a constant determined by the conditions at $R_{max}$ and at the shorted end of the tapered slot where θ and R are zero; and wherein a is a constant of exponentiation that determines the rate of exponentiation of said slot element edge.

9. The method of claim 7, further comprising the step of providing that at said feed point a coaxial cable makes a connection to a first of said plurality of slot element edges and to a radially opposite second of said plurality of slot element edges.

10. The method of claim 7, further comprising the step of providing a feed pipe which extends through an axis of said tapered slot.

11. The method of claim 10, further comprising the step of providing that at said shorted point said slot elements are electrically shorted to said pipe.

12. The method of claim 10, further comprising the step of providing that at said feed point at least two coaxial cables are connected to said pipe and to at least one radially opposite pair of slot element edges.

* * * * *